US007077618B2

(12) United States Patent
Knoch

(10) Patent No.: US 7,077,618 B2
(45) Date of Patent: Jul. 18, 2006

(54) DEVICE FOR LIFTING AND REMOVING OVEN DOORS OF A COOKING OVEN

(75) Inventor: Ralf Knoch, Gelsenkirchen (DE)

(73) Assignee: Uhde GmbH, Dortmund (DE)

( * ) Notice: Subject to any disclaimer, the term of this patent is extended or adjusted under 35 U.S.C. 154(b) by 601 days.

(21) Appl. No.: 10/398,306

(22) PCT Filed: Feb. 22, 2002

(86) PCT No.: PCT/EP02/01887

§ 371 (c)(1),
(2), (4) Date: Apr. 3, 2003

(87) PCT Pub. No.: WO02/077122

PCT Pub. Date: Oct. 3, 2002

(65) Prior Publication Data

US 2004/0099520 A1 May 27, 2004

(30) Foreign Application Priority Data

Mar. 21, 2001 (DE) ..... 101 13 891

(51) Int. Cl.
*B66C 23/00* (2006.01)

(52) U.S. Cl. ..... 414/684.3; 202/239; 202/270

(58) Field of Classification Search ..... 202/239, 202/270; 414/684.3; 212/166
See application file for complete search history.

(56) References Cited

U.S. PATENT DOCUMENTS 1,141,132 A * 6/1915 McIntire ..... 414/684.3
1,357,058 A * 10/1920 Hubbell ..... 414/684.3
2,142,451 A * 1/1939 McEwan ..... 414/684.3
2,179,608 A * 11/1939 Ragnar et al. ..... 414/684.3
2,299,916 A * 10/1942 McIntire ..... 414/684.3
2,442,349 A * 6/1948 Exum ..... 202/248
2,746,610 A * 5/1956 Henseleit ..... 414/684.3
2,746,611 A * 9/1956 Henseleit ..... 414/684.3
2,780,366 A * 2/1957 Henseleit ..... 414/684.3
2,784,849 A * 3/1957 Gillott ..... 414/684.3
2,796,995 A * 6/1957 Ackeren et al. ..... 414/684.3
2,797,820 A * 7/1957 Homan ..... 414/684.3
2,807,372 A * 9/1957 Henseleit ..... 414/684.3
3,014,746 A * 12/1961 Hibi ..... 292/259 R
3,709,794 A 1/1973 Edgar
3,957,591 A * 5/1976 Riecker ..... 202/263
3,985,627 A * 10/1976 Gebhardt et al. ..... 202/262
4,620,828 A * 11/1986 Lemke ..... 414/684.3
4,662,526 A * 5/1987 Schaller ..... 212/166

(Continued)

*Primary Examiner*—Glenn Caldarola
*Assistant Examiner*—Alexis Wachtel
(74) *Attorney, Agent, or Firm*—Collard & Roe, P.C.

(57) ABSTRACT

The invention relates to a device for lilting and removing oven doors of a coking oven that is comprised of a door removing head (1), which can be coupled to vertically extending oven doors of a horizontal chamber coking oven, of a drive device (3) for effecting adjusting movements of the door removing head (1), and of a suction hood, which can be displaced along the horizontal chamber coking oven above the oven door. According to the invention, sealing elements (5) are connected to the door removing head (1) and, on both sides of an oven door (2) to be opened, can be displaced against front contact surfaces (6) of the horizontal chamber coking oven. Said sealing elements extend essentially over the entire height of the oven door (2) and into the suction area (4) of the suction hood, and they form a suction chamber (8) for door emissions when the oven door (2) is opened.

6 Claims, 5 Drawing Sheets

U.S. PATENT DOCUMENTS 4,808,268 A * 2/1989 Feldhaus ..... 202/241

5,564,340 A * 10/1996 Baird et al. ..... 104/295

* cited by examiner

DEVICE FOR LIFTING AND REMOVING OVEN DOORS OF A COOKING OVEN

CROSS REFERENCE TO RELATED APPLICATIONS

Applicant claims priority under 35 U.S.C. §119 of German Application No. 101 13 891.1, filed Mar. 21, 2001. Applicant also claims priority under 35 U.S.C. §365 of PCT/EP02/01887, filed Feb. 22, 2002. The international application under PCT article 21(2) was not published in English.

DESCRIPTION

The invention relates to a device for lifting and removing oven doors of a coking oven comprising A door removing head that can be coupled to vertically extending oven doors of a horizontal chamber oven;

A drive device for effecting adjusting movements of the door removing head; and a suction hood that can be displaced along the horizontal chamber oven above the doors of the oven.

In a modern coking plant, emissions caused when the doors of the coking oven are lifted off and removed, are collected by a suction hood that can be displaced along the horizontal chamber oven and is positioned above the door-lifting device, and then passed by means of pipelines either into dust removal systems on the coke side, or to filter installations that are installed on the side on which the oven is controlled. The length of the suction head amounts to multiple times the width of an oven chamber in order to trap the emissions escaping when the doors of the oven are lifted and removed. Due to the large height of the chamber of a modern horizontal chamber oven, which often amounts to in excess of 6 meters, and due also to the unavoidable currents of air occurring in front of the doors of the oven, substantial amounts of emissions released when the doors are opened, in particular from the lower areas of the oven doors, are still not trapped by the suction head and thus released into the environment. It is a drawback, furthermore, that the suction lines, the suction blower and mainly filter installations have to be designed for large volumes of air.

The invention is based on the problem of improving the removal by suction of the emissions occurring when the oven door is opened.

Based on a device characterized by the features described above, the problem is resolved according to the invention in that sealing elements are connected with the door removing head and can be displaced on both sides of an oven door to be removed against front contact faces of the horizontal chamber oven. These contact faces extend substantially over the entire height of the suction hood and, when the oven door is opened, are forming a suction chamber for door emissions. The sealing elements resting against the front side of the horizontal chamber oven when the oven door is opened, delimit an upwardly open suction chamber feeding into the suction area of the suction hood. In this way, the emissions released when the door of the oven is opened are channeled and can be passed with relatively small amounts of air into the suction hood in a controlled manner. The arrangement as defined by the invention permits an almost complete collection of all emissions occurring when the door of the oven is opened, in particular also from the lower areas of the door.

The door removing head usefully comprised mechanical, electromechanical, pneumatic or hydraulic setting devices that control the setting movements of the sealing elements in such a manner that the sealing elements rest against the front-side contact surfaces of the horizontal chamber oven as the oven door coupled to the door removing head is being lifted and removed from the opening of the door. The sealing elements are preferably designed in the form of pivot-mounted wings. Furthermore, the sealing elements may be designed in the form of sliding walls that can be driven from a recessed resting position against the front-side contact surfaces of the horizontal chamber oven by a straight-line setting movement. Furthermore, it is possible to design the sealing elements in the form of single- or multi-component elements.

The coupling operation, in which the door removing device is coupled with an oven door to be opened, is not impaired by the sealing elements provided as defined by the invention. The sealing elements usefully can be moved between a resting position and a working position, whereby the sealing elements are pushed or swiveled back into the resting position to such an extent that the coupling operation taking place between the door removing head and the closed oven door can be observed.

The arrangement as defined by the invention permits the use of compact and small suction hoods. The suction head, which can be displaced along the horizontal chamber oven, preferably has a length that is not substantially exceeding the width of an oven chamber of the horizontal chamber oven. Suction lines connected to the suction hood, the suction blower and a filter installation downstream can be designed for streams of emissions with relatively small volumes.

The invention is explained in the following with the help of the drawing showing only one exemplified embodiment. The following is schematically shown in the drawing:

FIG. 5 shows another embodiment of the device as defined by the invention.

Figure 1:
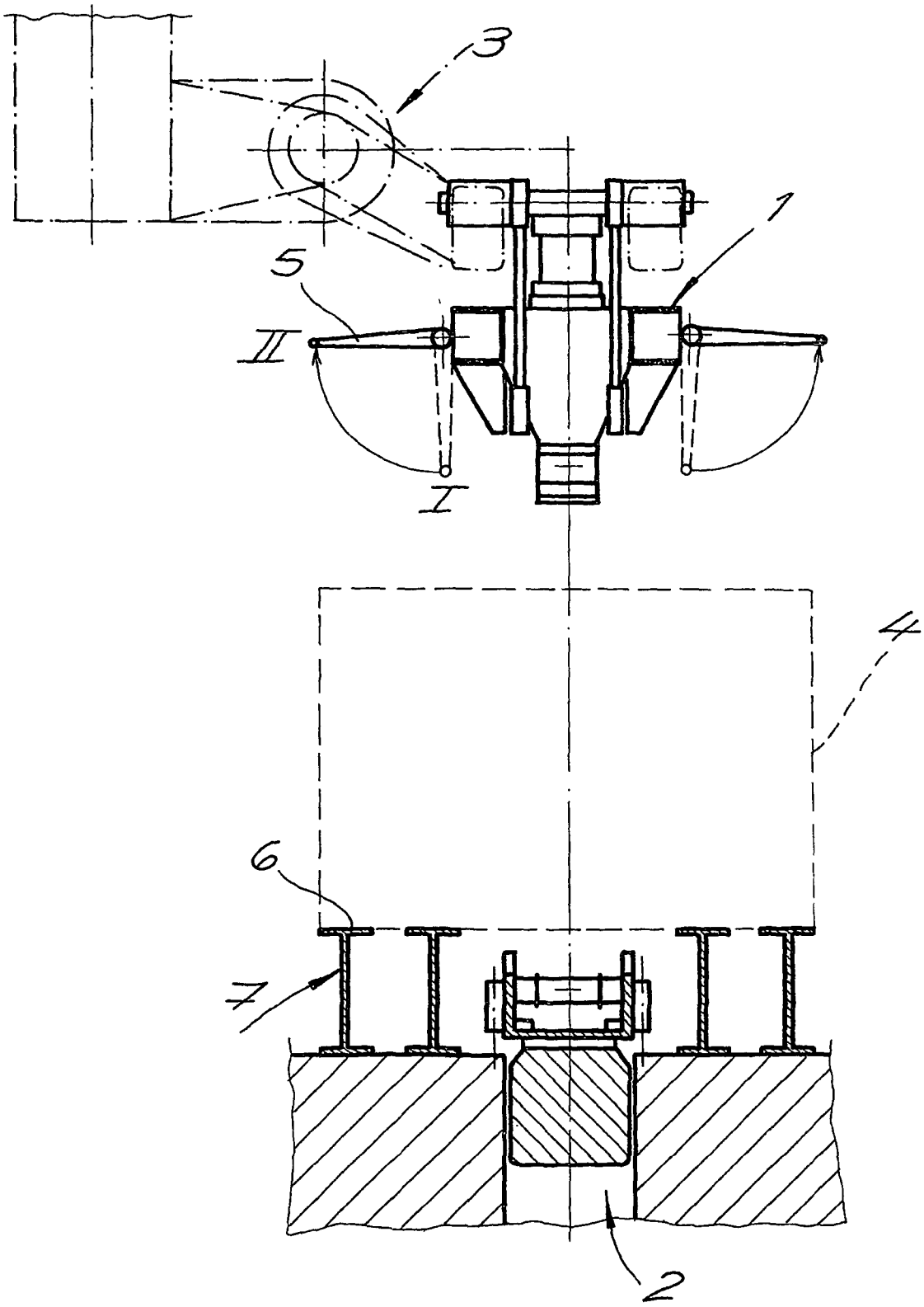
FIG. 1 shows a horizontal section through a closed oven door of a coking oven and a top view of the device for lifting and removing the oven door, with the device shown being positioned in front of the oven door.

The figures show a device for lifting and removing oven doors that is mounted on a machine for pushing out or transferring coke. The device has a door removing head 1 that is coupled to the vertically extending oven doors 2 of a horizontal chamber oven, and comprises a driving device 3 indicated only schematically, for setting movements of the door removing head 1. Furthermore, provision is made for a suction hood than can be displaced above the oven doors along the horizontal chamber oven. Its suction area 4 is shown dashed in the figures. The suction hood is positioned above the door removing device in front of the oven chamber of the horizontal chamber oven to be opened, and, in the exemplified embodiment as well as also according to a preferred embodiment of the invention, has a length not substantially exceeding the width of the oven chamber.

The sealing elements 5 are connected with the door removing head 1. These sealing elements can be driven from a basic position I, which is shown dashed in FIG. 1, into a position II shown by a fully drawn line. Provision is made for mechanical, electromechanical or hydraulic setting devices for controlling these setting movements. Setting devices with one or more hydraulic cylinders are preferably used.

Figure 2:
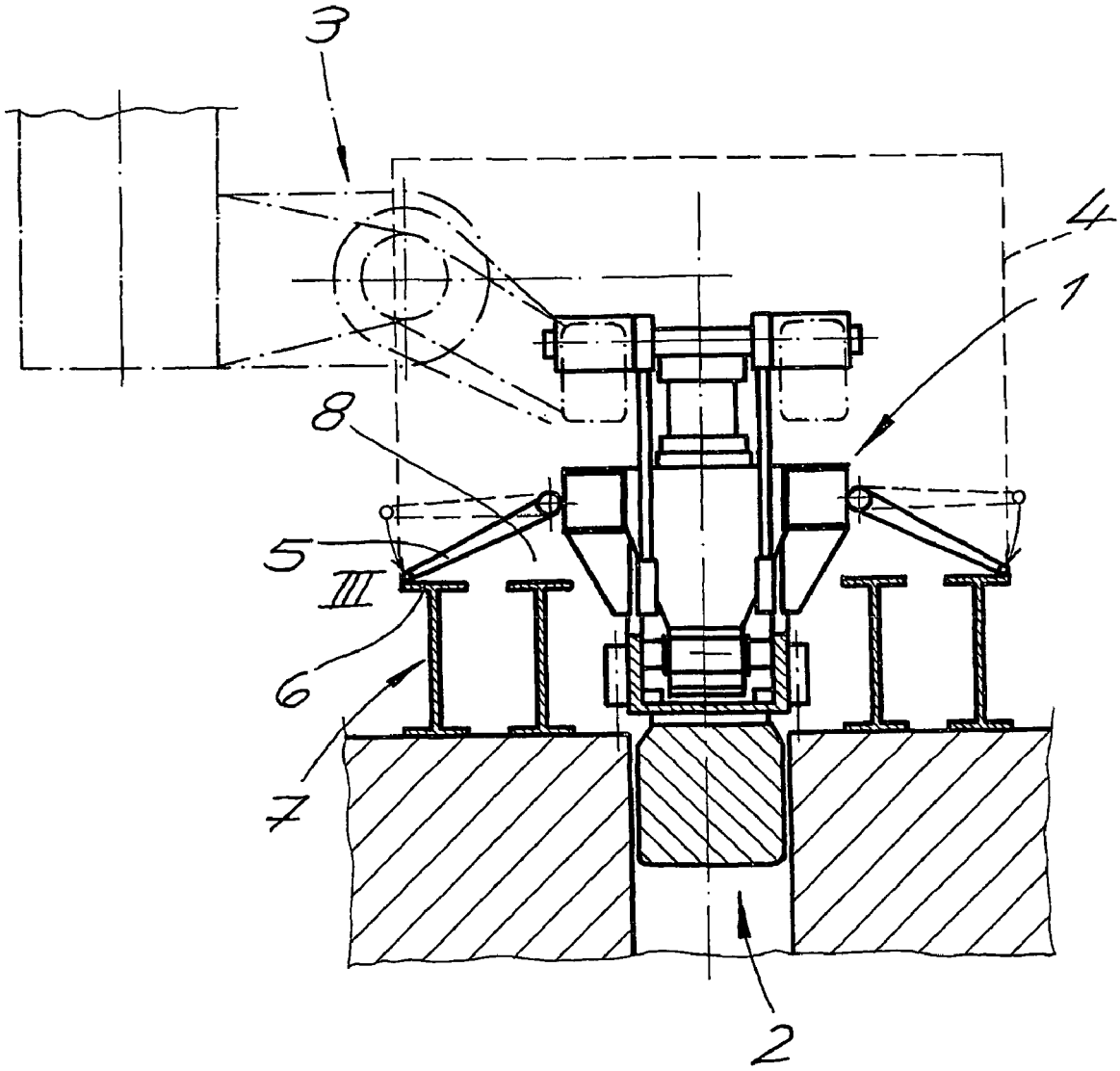
FIGS. 2 to 5 show the device shown in FIG. 1 in other functional positions.

From the position shown in FIG. 1, the door removing head 2 is driven up into the position shown in FIG. 2, and coupled to the oven door 2 to be opened. During the advancing movement, the sealing elements designed in the form of pivot-mounted wings are spread open and assume the position II shown in FIG. 1. The door removing head 1 is coupled to the oven door 2 in a manner known per se by hooking up lifting beams of the lifting head 1 in claws of the oven door 2. In the position II, the sealing elements are swiveled back to such an extent that the coupling operation taking place between the door removing head 1 and the closed oven door 2 can be observed. After the coupling has been completed, the wing-like sealing elements 5 are driven against the front-side contact surfaces 6 of the horizontal chamber oven and assume a working position III. In the exemplified embodiment, the contact surfaces 6 are designed in the form of the anchor stands 7. The sealing elements 5 are substantially extending over the entire height of the oven door 2 up into the suction area 4 of the suction hood, and are forming a channel-like suction chamber 8 for door emissions that are released when the oven door 2 is opened.

Figure 3:
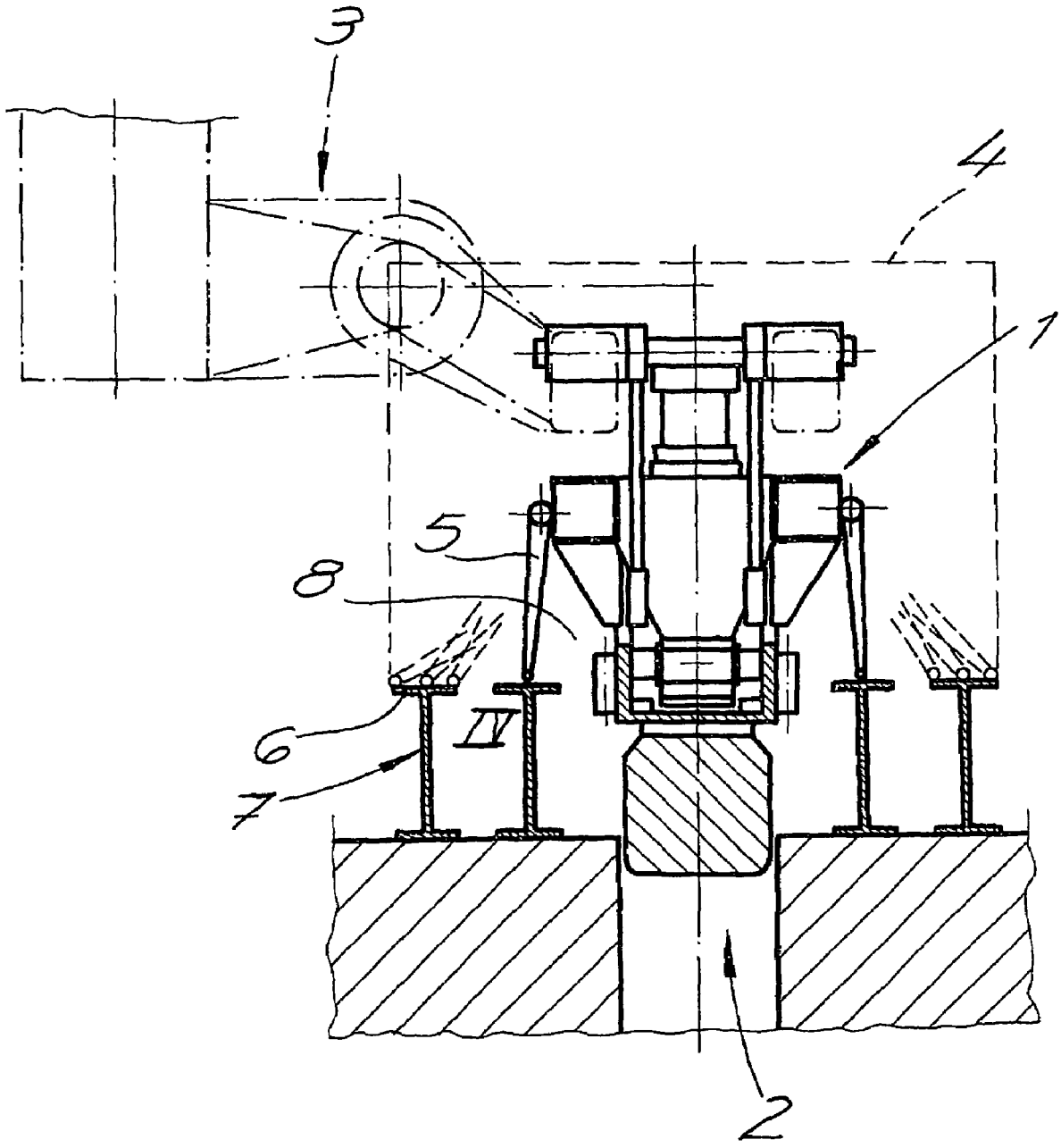

The operation implemented for lifting and removing the oven door from the opening of the door is shown in FIG. 3. The setting movements of the sealing elements 5 are controlled by the associated setting device in such a manner that in the course of the lifting movement, by which the oven door 2 coupled to the door removing head 1 is lifted and removed from the door opening, the sealing elements 5 will rest against the front-side contact surfaces 6 of the horizontal chamber oven. The representation shows that the sealing elements 5 designed in the form of wing-like elements are moving on the flanges of the anchor stands 7 in the direction of the oven door 2. The emissions exiting over the entire height of the oven door 2 are received in the suction chamber 8 and are then channeled upwards and passed in the direction of the suction hood. The emissions are not discharged into the environment. Before the pivot-mounted, wing-like sealing elements 5 reach the position IV shown in FIG. 3, the driving movement of the door removing device can be briefly stopped in order to obtain a longer suction time period.

Figure 4:
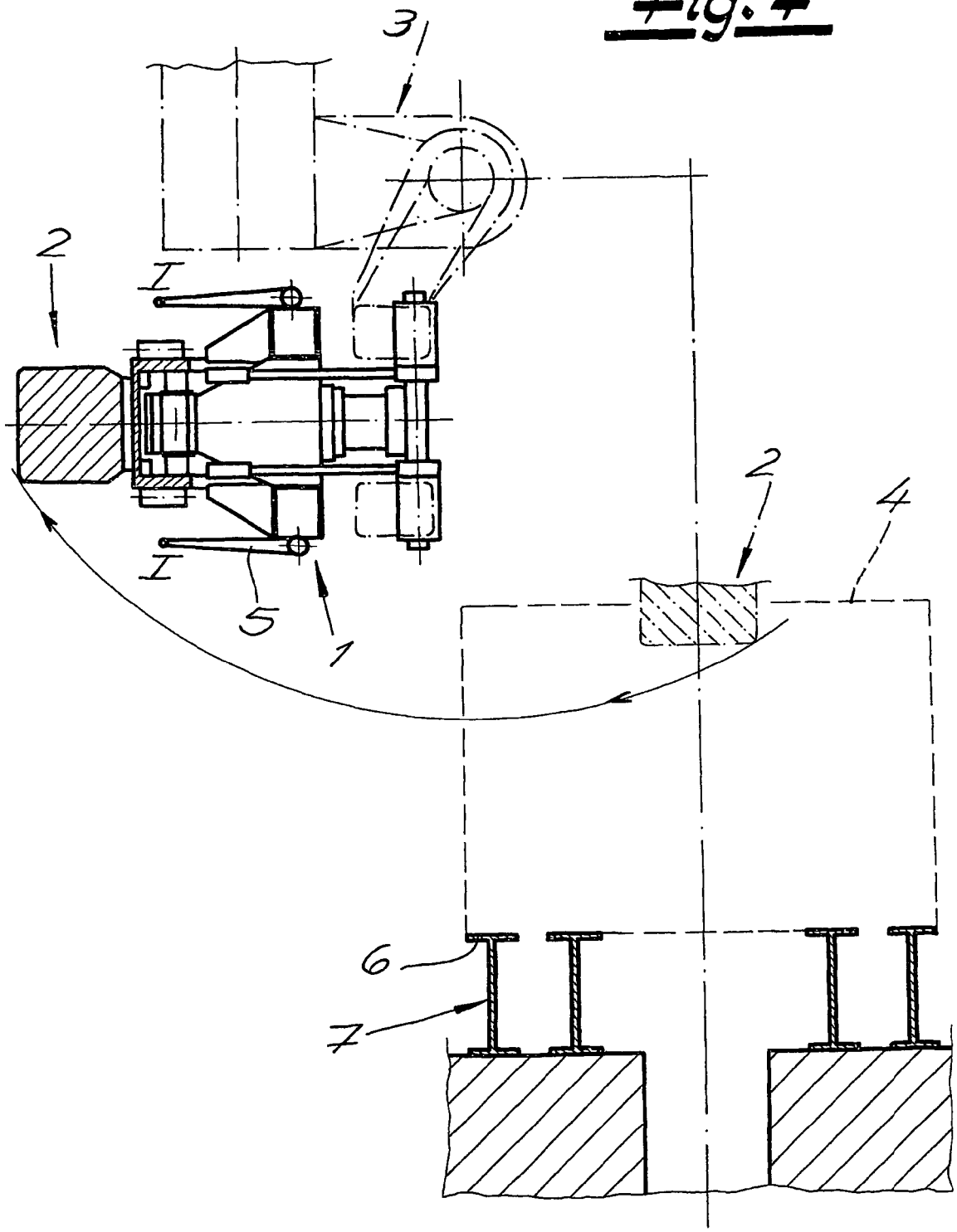

FIG. 4 shows the door removing head 1 with the oven door 2 coupled to it in the swiveled position in front of a device (not shown) for cleaning the oven door. The wing-like sealing elements 5 are in the basic position I.

Figure 5:
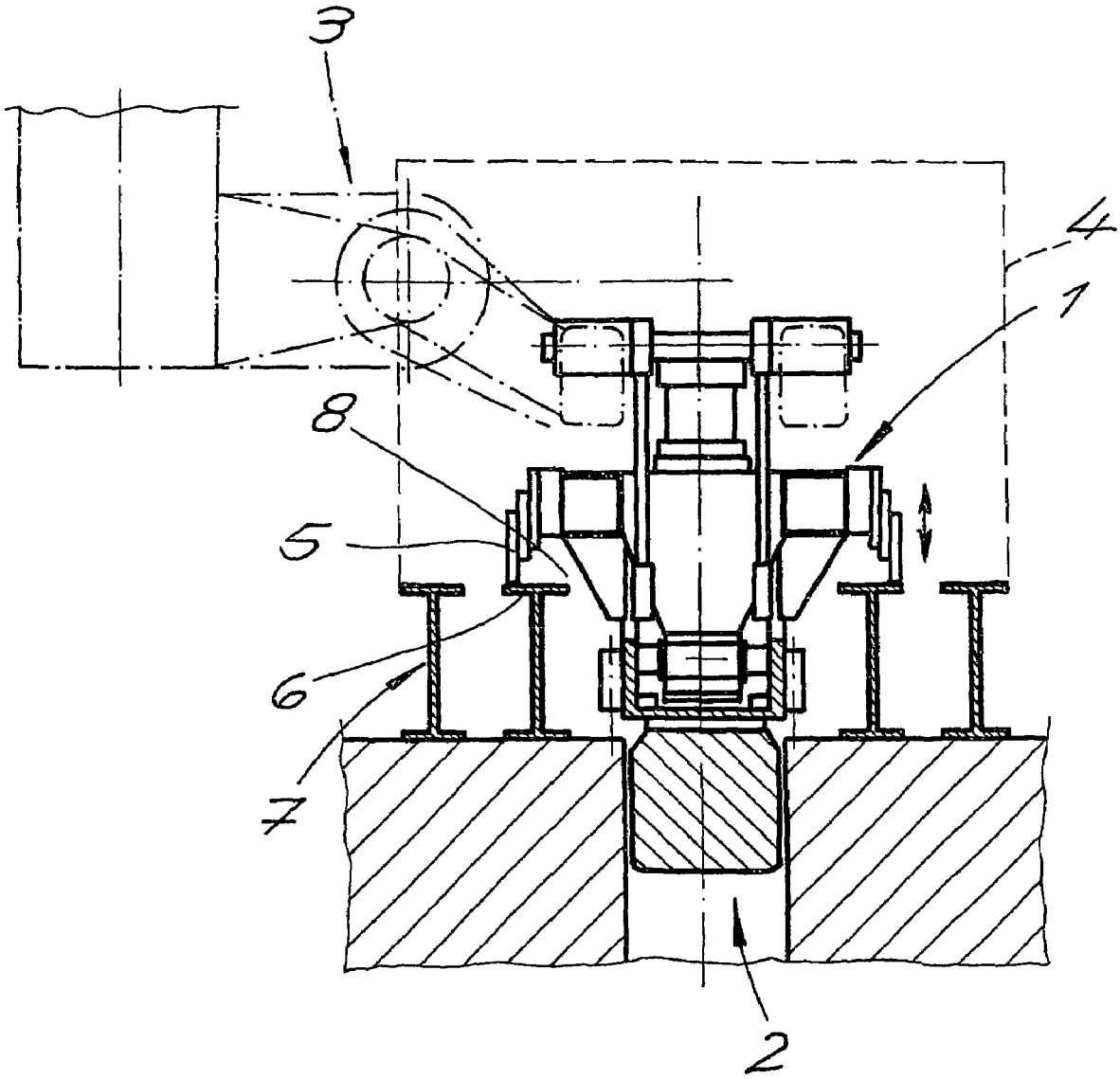

FIG. 5 shows another embodiment of the device as defined by the invention. In the present embodiment, the sealing elements 5 are designed in the form of multi-component sliding walls that can be driven from a recessed basic position and in a straight-line setting movement against the front-side contact surfaces 6 of the horizontal chamber oven.

The invention claimed is:

1. A device for lifting and removing oven doors of a coking oven comprising a door removing head (1) which can be coupled to vertically extending oven doors of a horizontal chamber oven;

a driving device (3) for setting movements of the door removing head (1); and a suction hood which can be displaced above the oven doors along the horizontal chamber oven;

characterized in that sealing elements (5) are connected to the door removing head (1), said sealing elements being movable on both sides of an oven door (2) to be opened against front-side contact surfaces (6) of the horizontal chamber oven, and extending substantially over the entire height of the oven door (2( ) up into the suction area (4) of the suction hood, and forming a suction chamber (8) for door emissions when the oven door (2) is opened.

2. The device according to claim 1, characterized in that the door removing head (1) comprises mechanical electro-mechanical, pneumatic or hydraulic setting devices controlling the setting movements of the sealing elements (5) in such a manner that the sealing elements (5) come to rest against the front-side contact surfaces (6) of the horizontal chamber oven as a lifting and removing movement of the oven door (2) coupled to the door removing head (1) is taking place.

3. The device according to claim 1 or 2, characterized in that the sealing elements (5) are designed in the form of pivot-mounted wings.

4. The device according to claim 1 or 2, characterized in that the sealing elements (5) are designed in the form of sliding walls movable from a recessed position by a straight setting movement against the front-side contact surfaces (6) of the horizontal chamber oven.

5. The device according to any one of claims 1 to 4, characterized in that the sealing elements (5) can be moved between a resting position (II) and a working position (III), whereby the sealing elements (5) are pushed or swiveled back in the resting position (II) to an extent such that the coupling operation taking place between the door removing head (1) and the closed oven door (2) can be observed.

6. The device according to any one of claims 1 to 5, characterized in that the suction hood has a length not substantially exceeding the width of the oven chamber of the horizontal chamber oven.

* * * * *